US005926111A

United States Patent [19]

Davis et al.

[11] Patent Number: 5,926,111

[45] Date of Patent: Jul. 20, 1999

[54] PULSED WIDTH MODULATED REMOTE SIGNALLING AND LOCATION IDENTIFICATION SYSTEM FOR SUMMONING A SERVICE INDUSTRY WORKER

[75] Inventors: Charles F. Davis, Cerulean, Ky.; Joseph V. Bednar, Carrollton, Tex.

[73] Assignee: D & B Supply, Inc., Cerulean, Ky.

[21] Appl. No.: 08/541,197

[22] Filed: Oct. 16, 1995

Related U.S. Application Data

[63] Continuation of application No. 08/297,168, Aug. 29, 1994, abandoned.

[51] Int. Cl.[6] ..... G08C 19/22

[52] U.S. Cl. ..... 340/825.63; 340/332; 340/286.09; 340/825.69; 340/825.36; 345/48; 345/84; 455/95; 455/105; 370/212; 375/238

[58] Field of Search ..... 340/332, 286.09, 340/286.07, 286.06, 286.08, 286.11, 286.01, 825.63, 825.72, 825.69, 825.56, 825.57, 825.36; 345/48, 55, 84, 100, 208; 455/67.7, 95, 103, 104, 105; 395/211; 370/205, 212; 375/238

[56] References Cited

U.S. PATENT DOCUMENTS

| | | | |
|---|---|---|---|
| Re. 35,364 | 10/1996 | Heitschel et al. | 340/825.69 X |
| 3,858,116 | 12/1974 | Friedl et al. | 340/825.63 |
| 3,944,982 | 3/1976 | Mogi et al. | 340/825.63 X |
| 3,984,775 | 10/1976 | Cariel et al. | 340/825.63 X |
| 4,159,448 | 6/1979 | Parham | 340/825.63 X |
| 4,315,249 | 2/1982 | Apple et al. | 340/825.63 X |
| 4,701,849 | 10/1987 | Elden | 364/401 R |
| 4,777,488 | 10/1988 | Carlman, Jr. et al. | 340/825.72 |
| 5,032,834 | 7/1991 | Kane et al. | 340/332 X |
| 5,146,215 | 9/1992 | Drori | 340/825.69 X |
| 5,594,409 | 1/1997 | Shank | 340/286.06 X |
| 5,650,774 | 7/1997 | Drori | 340/825.69 X |

*Primary Examiner*—Brian Zimmerman
*Assistant Examiner*—William H. Wilson, Jr.
*Attorney, Agent, or Firm*—Rick R. Wascher

[57] ABSTRACT

A system for summoning a service industry worker using pulsed width modulation for remote signalling having a number of signalling switches, each connected to a transmitter. When a switch is activated, the corresponding transmitter transmits an RF carrier modulated by a lower frequency tone, turning the tone on and off in a pattern determined by a unique code assigned to the switch. A central receiver filters the signal from the transmitter and converts the tone pattern to a binary output to a computer. The computer instructs a display unit to turn on a light corresponding to the switch by sending its number in a serial bit stream of all lights that should be on. The bit stream is interpreted by circuits in the display unit using a clock signal. Upon the clock signal, the bit is sent to the appropriate register, which is used to turn on the correct light.

11 Claims, 5 Drawing Sheets

PULSED WIDTH MODULATED REMOTE SIGNALLING AND LOCATION IDENTIFICATION SYSTEM FOR SUMMONING A SERVICE INDUSTRY WORKER

This is a continuation of application Ser. No. 08/297,168 filed on Aug. 29, 1994 now abandoned.

BACKGROUND OF THE INVENTION

1. Field of Invention

The present invention relates generally to systems for controlling one or more local displays via a remote transmitter device, but more particularly to such systems useful for sending information from one of many remote locations to a central receiving station in such a manner that the receiving station is capable of detecting the point of origin of the information without the need for further communication with the transmitting station.

2. Description of the Related Art

In many situations it is desirable to have a system that will allow people at multiple locations to signal someone at a central location when assistance is desired. An example of such a situation is in a restaurant where customers may need to summon a waiter or waitress to their table. This example will be used in this application to explain the function of the invention, but other examples of similar situations are in retail stores, manufacturing plants and health care facilities, to name but a few.

In the industry and related art, it is important to understand the major distinction between the two major independent divisions of technology, and the unique incorporation of one such division into present invention and the use of the other such division in the art to which the invention relates. The known signalling systems comprising the art to which the invention relates are constructed of components to operate in accordance with the principle of frequency shift keying or amplitude modulation. Frequency Shift Keying (FSK) communicates information in binary one and zero format by utilizing two different frequencies (one frequency equal to a binary one, the other frequency equal to a binary zero) and pulsing between the two frequencies to communicate information in a binary code. Frequency Modulation (FM), on the other hand, shifts the frequency of a carrier signal in a range between a specified low frequency and a specified high frequency in order to replicate and communicate an analog signal. Devices configured for frequency shift keying/modulation are believed to provide one method of remote location communication, and devices incorporating pulsed width modulation provide another method remote location communication.

Frequency shift keying and pulsed width modulation are not compatible. The structure of such devices are for the most part not interchangeable, and the operation of one device cannot be modified to perform the functions of the other. Therefore, frequency modulation and pulsed width modulation are believed by those skilled in the industry as mutually exclusive in structure and operation.

Frequency modulated devices are known to have operational limitations relating to range of operation, the need for a polling function and the separation distance of the transmitter/receiver components and the central receiving/transmitting station. Such limitations are known to cause errors in signal transmission. Pulsed width modulation, on the other hand, is believed to enable improved message transmission and reception over frequency modulated devices, and does not require structure to enable a polling function.

U.S. Pat. No. 4,777,488 granted to Carlman, Jr. et al., incorporated by reference as if fully set forth herein, is an example of a device that uses frequency modulation to modulate the information carrier. The Carlman patent is directed to a restaurant service request communication system. Carlman using frequency modulation and a polling technique to effectively slot the messages in a certain predetermined order which is likely to be different than the order in which they are sent or received.

Carlman's central receiver at the central receiving station continuously monitors, when not in a wait state, the single frequency transmission for any signal, then polls the signal string in order to determine the position a signal message is in line (ahead of or behind other messages), holds and then decodes the position in line to reveal the corresponding location. Carlman also uses a confirming message sent back from the central receiving station to where the signal is thought to have been originated in order to verify the intended location of the message in the preselected que.

The Carlman carrier is frequency modulated with two separate tones. The signal is sent by a transmitter and then recovered by the receiver and converted back into on and off pulses. In amplitude modulation, about 25% of the power is contained in the modulated signal and 75% in the carrier.

The Carlman system contains a transmitter and a receiver at each remote location. The remote transmitter is only allowed to send a signal (message) at a specific time or sequence and then must wait for an acknowledgement signal to be sent from the central receiver station to the remote location (hereinafter "polling"). Polling is a costly approach because a receiver and transmitter combination is required at each location and must be receiving whenever a signal needs to be sent. Additionally, as transmitters are added, the polling time must be increased to accumulate all the transmitter time slots. The polling function looks for signals sent in a prescribed order, such that a given signal sent from a corresponding specific location takes a place in line other than the order in which it was sent or received.

It is further important to point out that all DA converter functions, including devices incorporating frequency modulation and pulsed width modulation, must operate within the limitations of the FCC regulations. The distinction between the two such devices is that pulsed width modulated devices place most of its power at the carrier frequency as compared to frequency modulated (i.e., shift keying) devices which use much of their power performing the polling function and signal verification and still be within FCC guidelines. The result is that the signals sent by pulsed width devices can be sent from a greater distance with greater degree of reliability as compared to frequency modulated devices. Devices incorporating frequency modulation uses a single frequency with two tones, e.g., 1200 and 1800 Hertz tones. The two different tones are frequency modulated on the carrier radio frequency signal and are used for positioning within the poll.

In addition, the "polling" or "time slotting" function of frequency modulated devices must include a time basis associated with various transmitter units (e.g., table units and the master units of the, for example, the Carlman invention). The time basis of the table and master units must be synchronized. This is required because the random transmission of signals from the table units initiates the coded start signal, which in turn synchronizes the table and master unit time bases so the polling function of the overall system allows the individual table signals to be received in a preselected order, an order other than the order in which the signals were sent, such that the physical identity of the location of the originating signal can be determined only through a comparison of the preselected order and the existence of a signal positioned within its one individual position.

In addition to the Carlman reference, the remote signalling devices comprising the art to which the invention relates further include:

U.S. Pat. No. 4,935,720 granted to Kalfoun, incorporated by reference as if fully set forth herein, is directed to an apparatus for the transmission of information in a restaurant.

U.S. Pat. No. 4,722,053 granted to Dubno et al. on Jan. 26, 1988, incorporated by reference as if fully set forth herein, is directed to a food service ordering terminal with video game capability.

U.S. Pat. No. 4,530,067 granted to Dorr on Jul. 16, 1985, incorporated by reference as if fully set forth herein, is directed to a restaurant management information control method and apparatus.

U.S. Pat. No. 4,222,111 granted to Sloan et al. on Sep. 9, 1980, incorporated by reference as if fully set forth herein, is directed to a method and apparatus for monitoring status of tables in a restaurant.

U.S. Pat. No. 3,962,689 granted to Brunson on Jun. 8, 1976, incorporated by reference as if fully set forth herein, is directed to a memory control circuitry.

U.S. Pat. No. 3,821,707 granted to Peters on Jun. 28, 1974, incorporated by reference as if fully set forth herein, is directed to a waitress call system for cocktail lounge, restaurant, or the like.

U.S. Pat. No. 3,665,313 granted to Trent on May 23, 1972, incorporated by reference as if fully set forth herein, is directed to a location identification system.

U.S. Pat. No. 3,439,320 granted to Ward on Apr. 15, 1969, incorporated by reference as if fully set forth herein, is directed to a personnel location system.

U.S. Pat. No. 3,310,797 granted to Auger on Mar. 21, 1967, incorporated by reference as if fully set forth herein, is directed to a method and apparatus for coordinating restaurant operation.

U.S. Pat. No. 1,796,668 granted to Sarfatty on Mar. 17, 1931, incorporated by reference as if fully set forth herein, is directed to a restaurant service system and apparatus.

SUMMARY OF THE INVENTION

The invention is a remote signalling system and device which uses multiple signalling switches, multiple transmitters, a receiver connected to a computer and a display unit. This system can be used for remote security systems or it may be used, in accordance by a patron of a restaurant to summon a waiter or waitress to their table.

The present invention is a pulsed width modulated device, as compared to a frequency shift keying (i.e., frequency modulated) device, and includes the appropriate structure distinguishing it from frequency modulated devices. The carrier in a frequency modulated device incorporates two separate tones which are then recovered by the receiver and converted back into on and off pulses. Unlike frequency modulated devices, the inventive system converts signals to on and off pulses without any frequency or amplitude modulation of the carrier.

Most remote signalling systems have limited distance and are prone to errors in signal transmission. The inventive system and apparatus attempts to minimize these problems while still providing a cost effective solution. This system uses a modulation technique which places information on a transmitter carrier by a process known as "pulse-width encoding" or "keyed cw" by turning the carrier on and off. This modulation technique has several advantages over other modulation techniques, namely amplitude and frequency modulation (i.e., frequency shift keying). The main advantage is that more power can be placed in the carrier signal and hence obtain a greater distance and improved signal integrity.

This system places 100% of the available power in the carrier, opposed to about 25% of the power is contained in the modulated signal and 75% in the carrier of a frequency shift keying device (e.g., amplitude modulated device). Unlike the inventive system and apparatus that is able to extract a weaker signal from a single frequency carrier and hence capable of operating at greater distances, with respect to frequency modulated devices, the frequency bandwidth is wider than a single carrier and hence more energy must be placed in the frequency bandwidth.

The inventive device is capable of sending a plurality of pulsed-width modulated signals from a transmitter at any location and recognize them in the order sent without the need for placing them in line for position recognition before the location of the table can be determined (i.e., polling for rearranging their places in line to fit a discrete order). Such a construction and associated operation is believed to give "real time" responses, because it dispenses with the need for a polling function and the location of transmission of those individual signals have associated preset and recognizable signatures.

The inventive system incorporates several features which allow the recovery of the information in the carrier signal. This is necessary because this system can recover very weak and noisy carrier signals that might contain error information. Two methods are used to recover and valid information. First, the carrier signal is turned on and off in a predefined sequence to form a message. The message contains an address field which defines which transmitter sent the message, a data field which defines which button pressed, and a checksum which validates the message. If any part of the message is invalid it will be rejected. Secondly, the message is repeated 3 times to yield a higher success rate if one of the messages is rejected due to a transmission error.

The inventive system and apparatus are believed to be more cost effective over other systems because the transmitting unit is a simple key carrier and does not require more complex modulation circuitry require by amplitude and frequency modulated transmitters. Likewise, the receiver is a simpler and more cost effective device because it is not required to demodulate the received signal. The brain of the system is contained in a microprocessor computer that interprets the keyed carrier message and converts it into a form that the display requires.

Each switch of the present invention enables the transmitter. In the restaurant example, a transmitter is positioned on each table requiring remote signalling capability. The transmitter is in the form of a key pad unit similar to a remote control for a television or stereo.

The switches are associated with the buttons of the key pad. When a button is depressed, the corresponding switch is activated. In response, the transmitter associated with the switch emits a radio-frequency ("RF") carrier signal preferably around 320 MHz. Of course, other frequencies can be utilized but frequencies around 320 MHz are preferred. Each signal is modulated to form a signal containing a unique code assigned to the particular switch activated. The transmitter turns the tone on and off to send the unique binary code corresponding to the button.

The signal is picked up by a central receiver, e.g., a receiver centrally located within the environment in which the invention is used. The central receiver filters the signal from the transmitter tone pattern to a binary output. The binary output is then fed into a computer. The computer is configured to react to the binary signal and convert its message into a serial bit stream. The number of the serial bit stream corresponding to the activated switch initially depressed is fed into a display unit to turn on a light corresponding to the activated switch. The bit stream is interpreted by circuitry in a display unit using a clock signal. The clock signal is in turn fed into the appropriate register, which is used to turn on the correct light.

The remote signalling system invention, therefore, can be summarized in a variety of ways, which includes the following: at least one transmitter configured to transmit an RF carrier signal; a plurality of signalling switches each having an unique code, wherein the plurality of switches is connected to the at least one transmitter; means for pulsed width modulation of the RF carrier signal; means for receiving an RF carrier signal; means for converting the RF carrier signal to a binary signal; and at least one light corresponding to the plurality of signalling switches capable of being actuated in the operable on or off mode in response to the binary signal.

The means for pulsed width modulation of the RF carrier may be associated with the transmitter. There is at least one transmitter which will be associated with one display light but the invention does not limit multiple transmitters communicating with multiple receivers and controlling multiple displays. A receiver is normally associated with one display. The remote signalling system of the present invention is also useful for summoning a service industry worker by depressing a button on a keypad of a remote signalling system, wherein the signalling system includes the aforementioned elements.

Furthermore, the remote signalling system invention may also be summarized as including the following elements: a plurality of uniquely coded signalling switches; a plurality of transmitters wherein each of the switches is translated to a unique coded signal to be sent by the transmitters. Each transmitter is configured to transmit a radio frequency carrier signal modulated by a pulsed width modulation; means for receiving the carrier signal; means for converting the pulsed width to a binary signal; and a display having a plurality of lights, wherein each of the lights corresponds to a switch, and each light is turned on and off by the binary signal.

It is an object of the present invention to provide a system and device for sending information from one location to another.

It is an object of the present invention to provide a system useful in the services industry to send information from one location to another.

It is a further object of the present invention to provide the restaurant industry and particularly a patron thereof with a system and device for summoning service personnel when in need of assistance.

It is yet another object of the present invention to accomplish any one of the stated objectives by a system, consisting of a transmitter, a receiver, a processing unit, and a display board.

The invention may also be summarized in a variety of other ways. In addition, it is believed to be within the scope of the present invention to provide other objects, advantages and features which are not set forth above, but are contemplated by the teachings herein.

DETAILED DESCRIPTION OF THE PREFERRED EMBODIMENT(S)

Figure 1C:
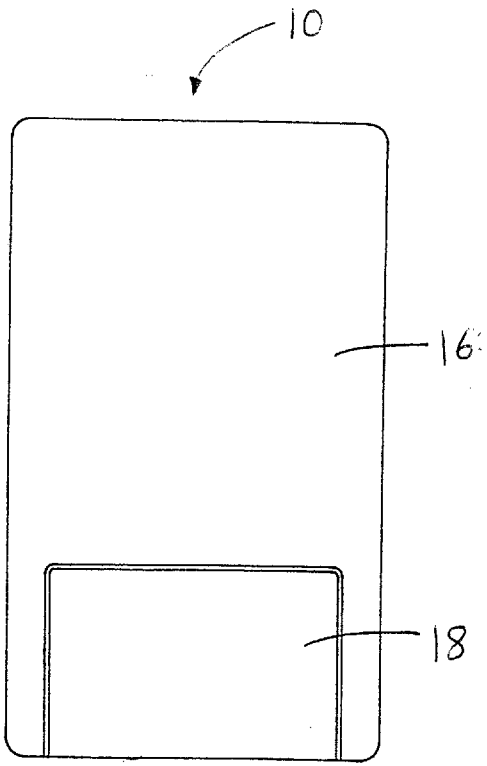
FIGS. 1A through 1C are directed to front, side and back views of the keypad component of the system of the present invention.
Figure 1B:
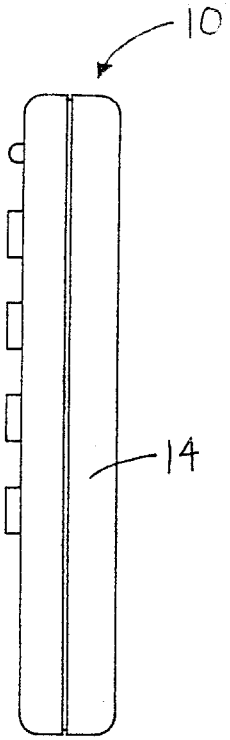

With reference to FIGS. 1A–1C and 2, the keypad component of the present invention is designated generally by the reference numeral 10 and the display readout component is designated generally by the reference numeral 30. Keypad 10 has a front 12, a side 14, and a back 16 with a battery cover plate 18 fitting flush therewith. The keypad resembles a remote control device commonly associated with television sets, and is preferably powered by two "AAA" batteries or one nine (9) volt battery.

Figure 1A:
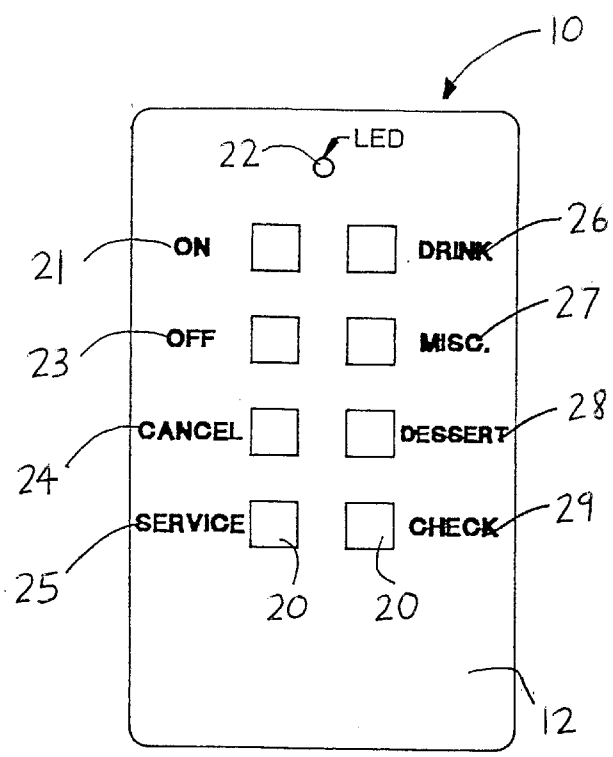

In FIG. 1A, the front of an embodiment of the keypad 10 is shown as having eight select buttons each of which is designated by the reference numeral 20, and LED indicator 22. The LED indicator 22 is provided as a means to show the user when the device is in the "ON" position. Also in the front 12 of keypad 10 is a variety of indicia such as "ON 21", "OFF 23", "CANCEL 24", "SERVICE 25", "DRINK 26", "MISCELLANEOUS 27", "DESSERT 28," and "CHECK 29". When any of the corresponding buttons 20 is depressed alongside the user select indicia 21–23, and 24–29, the appropriate signal is generated by the internal components of the keypad 10 and is transmitted to the display device 30 wherein a number is lit. Typically the number of the display device 30 corresponds to the identification number of the particular waiter or waitress receiving or servicing the table at which the patron who depressed keypad is seated.

Figure 2:
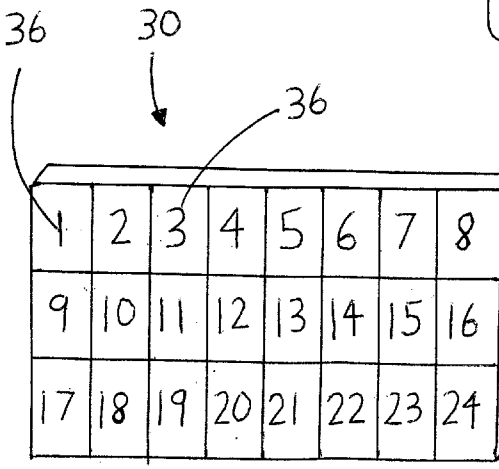
FIG. 2 is a representational perspective view of an embodiment of the display component of the system of the present invention.

With reference to FIG. 2, display 30 has a cabinet 32 with a front cover 34 having a plurality of numbers 36 positioned thereon. In the preferred embodiment of the invention, the number of numbers 36 is 24 which indicates twenty-four servers or twenty-four stations having keypad mechanisms.

Attention will now be directed to FIGS. 3–6, which illustrate the pertinent portions of the preferred structural components including, but not limited to, the transmitter, the receiver, the computer and the display.

Figure 3:
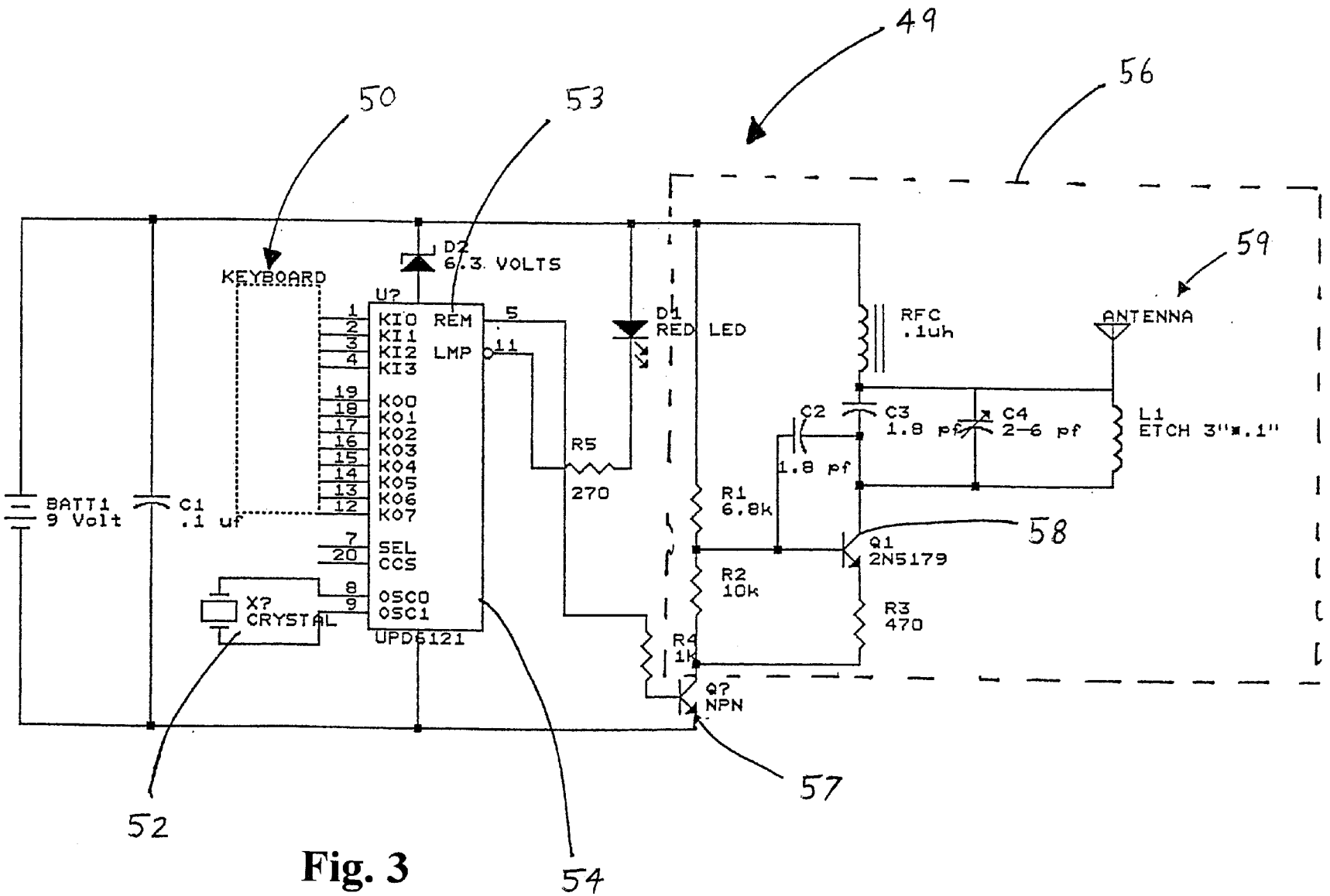
FIG. 3 is a schematic of the transmitter of the system of the present invention.

Shown in FIG. 3 is the transmitter component of the system. The keyboard indicated on the schematic as 50 is an advanced input device or an equivalent device capable of achieving the result set forth herein. The crystal designated as 52 and referenced as "X? CRYSTAL" is a Murata CSB 455 (KH2), and the transmitter internal components, designated generally by the reference numeral 54, are manufactured by NEC. The circuitry contained within the dashed lines, designated generally by the reference numeral 56, is the RF-oscillator preferably having a rating of 328 MHZ and 10 mW.

Figure 4:
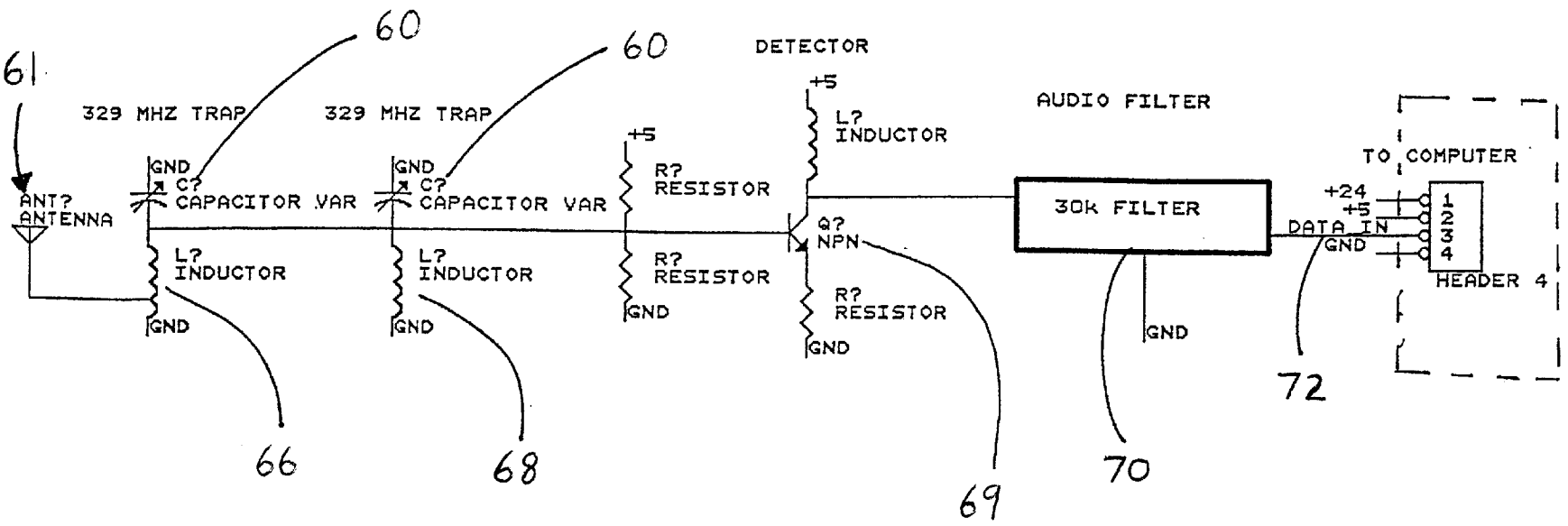
FIG. 4 is a schematic of the receiver of the system of the present invention.

With reference to FIG. 4, the variable capacitors, designated generally by the reference numeral 60 and annotated with "C? CAPACITOR VAR", are variable capacitors having a rating of 3–10 picofarads (pf). The resistors, designated generally by the reference numeral 62 and 64 and annotated with "R? RESISTOR" are 10K ohm and 680 ohm resistors respectively, the inductors are designated generally by the reference numerals 66 and 68. Filter 70 is a Mariti Erie 30k filter model number AFL7520000A1.

Figure 5:
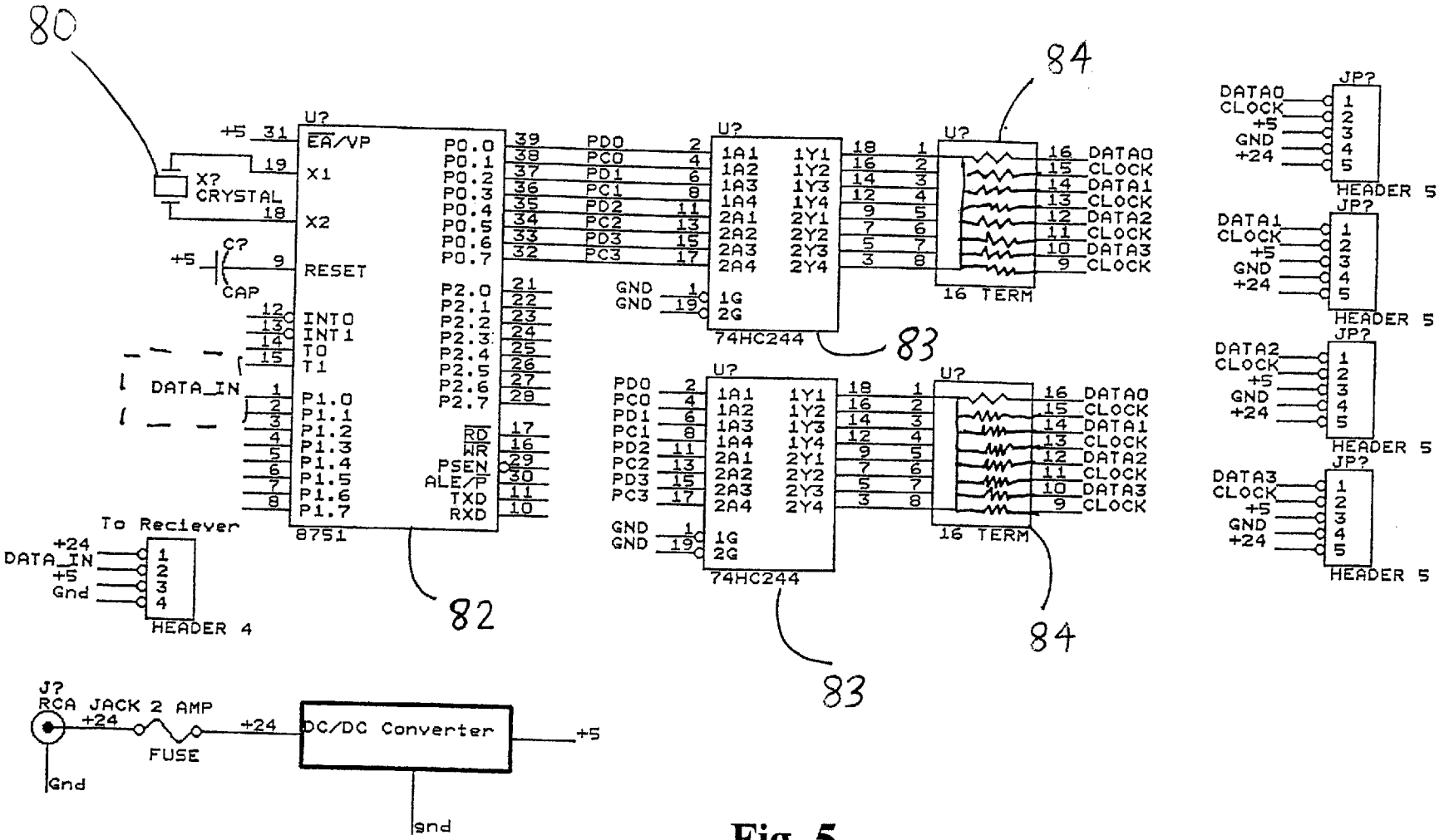
FIG. 5 is a schematic of the computer controller of the system of the present invention.
Figure 6:
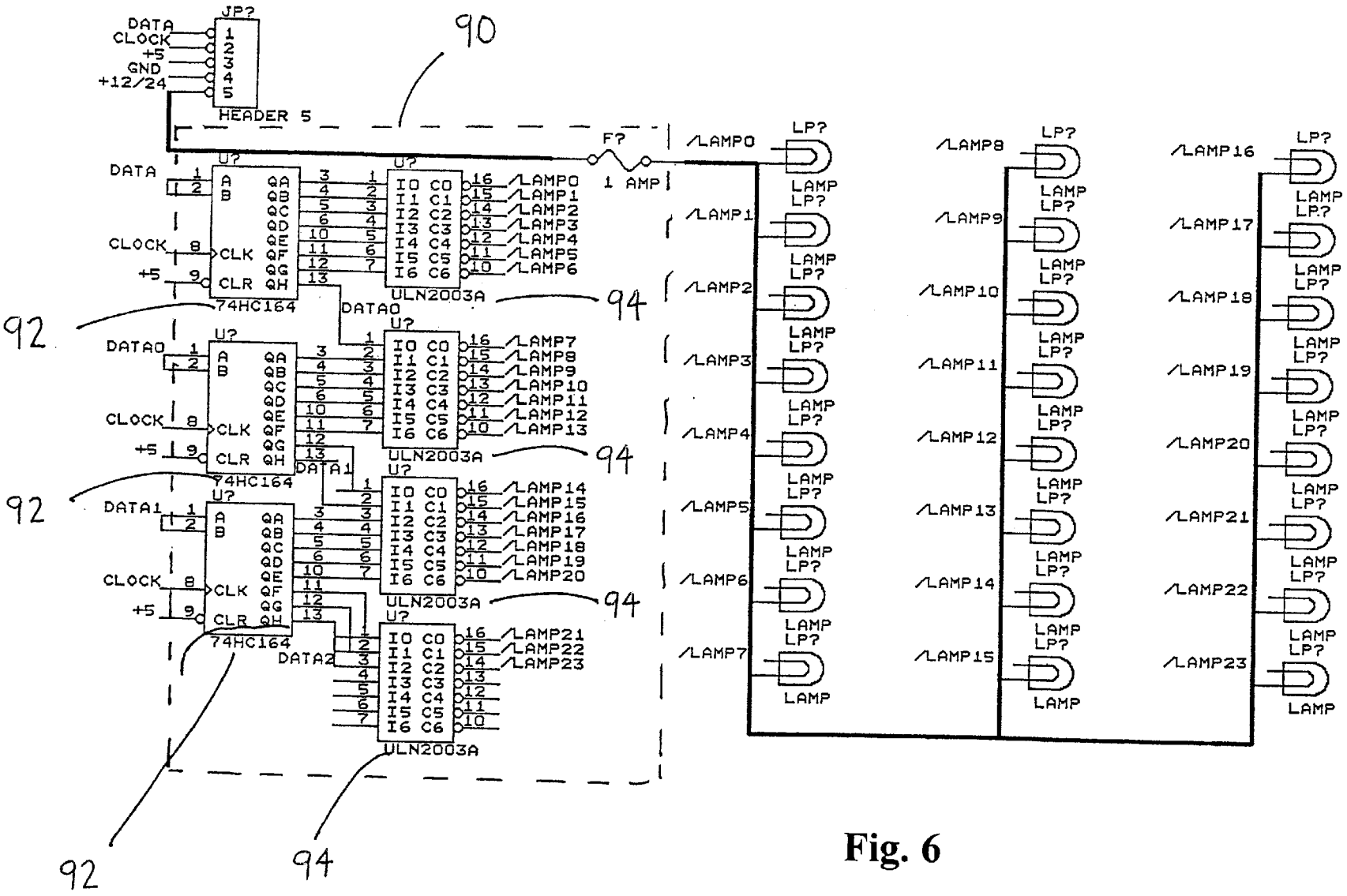
FIG. 6 is a schematic of the preferred embodiment of the display of the present invention.

With reference to FIG. 5, crystal 80 is a 12 mhz crystal. Microcontroller 82 is an Intel Microcontroller model number 87C51A. With reference to FIG. 6 the lamps are Chicago Miniature lamps model number CM7344.

MODE OF OPERATION

The preferred embodiment of the invention will now be described in more detail with an example. Each table in a restaurant is equipped with a service button. When service at the table is needed the customer can depress the button. When the button is activated a light emitting diode is lit to signal that the signalling device is activated, and the transmitter begins transmitting its signal.

The transmitter sends an RF carrier at a frequency of approximately 320 MHz. The carrier is modulated with a 30 kHz tone. The transmitter turns the tone on and off to send the unique binary code corresponding to the button. A receiver receives the RF signal sent by the transmitter.

A low pass filter serves as a detector for the tone. The detector passes the signal to a band pass filter centered at 30 kHz. The binary coded signal passes to a comparator which produces a binary pattern for the computer.

The computer accepts and processes the binary signal from the receiver. The received code is analyzed for validity. When the computer receives the same valid code three times, the code is accepted as accurate. The computer then signals the display unit to light the light corresponding to the code, and hence the activated button.

The display of all the lights is controlled by just four wires—clock, data, power and ground—and the data signals from the computer. The computer sends as a serial bit stream a message containing the identity of all the lights on the display unit which should be lit. As each bit is sent a clock signal sends the bit to the appropriate register in the display unit. The register is used to light the corresponding light on the display unit. The lights, therefore, are not lit simultaneously, but sequentially. Because of the high speeds at which the data is sent, the intensity of the lights is not observably diminished until a relatively large percentage of the lights are lit.

When a light on the display unit is lit the waiter serving the corresponding table is alerted to the fact that his attention to the table is requested. Upon arriving at the table the waiter deactivates the button by pressing it. This action turns off the corresponding transmitter and light.

The embodiment and uses of the invention described above are examples of possible embodiments and uses of the invention. Other embodiments and uses of the invention, and modifications in and changes to the invention, will be apparent, and may be made without departing from the scope or spirit of the invention as claimed.

What is claimed is:

1. A remote signaling system incorporating pulsed width modulation, comprising:

a plurality of uniquely coded signaling switches;

a plurality of transmitters wherein each of the switches is connected to one of the transmitters, and each transmitter is configured to transnit a radio frequency carrier signal modulated by a pulsed tone wherein each frequency is the same for each of the plurality of transmitters;

means for receiving the carrier signal; and means for converting the pulsed tone within the frequency carrier signal to a binary signal wherein each binary signal from different transmitters of the plurality of transmitters is different and corresponds to an address identity of the transmitter that sent the carrier signal.

2. The remote signalling system of claim 1, wherein:

the means for converting the pulsed tone of the RF carrier to a binary signal is associated with the transmitter.

3. The remote signaling system of claim 1, wherein:

the frequency of the RF signal is in the range of frequencies from 300 to 340 megahertz.

4. The remote signaling system of claim 3, wherein:

the frequency is 320 megahertz.

5. The remote signaling system of claim 1, further comprising:

at least one light corresponding to the identity of the single transmitter of the plurality of transmitters that sent the signal and capable of being lit in response to the binary signal received by the a means for receiving a carrier signal.

6. The remote signaling system of claim 5, wherein:

the at least one light further comprises a display having a plurality of lights, wherein each of the lights corresponds to a switch, and each light has a corresponding transmitter assigned to it enabling a specific light of the plurality of lights to be turned on and off by the binary signal of its corresponding transmitter.

7. The remote signaling system of claim 1, wherein:

each of the plurality of transmitters operates on the same frequency simultaneously.

8. A method of summoning a service industry worker, comprising the steps of:

providing a remote signaling system comprising a keypad, a plurality of uniquely coded signaling switches, a plurality of transmitters wherein each of the switches is connected to one of the transmitters, and each transmitter is configured to transmit a radio frequency carrier signal modulated by a pulsed tone, means for receiving the carrier signal, means for converting the pulsed tone to a binary signal, and a display having a plurality of lights, wherein each of the lights corresponds to a switch, and each light is turned on and off by the binary signal; and depressing a button on the keypad to trigger one of the plurality of uniquely coded signaling switches in order to transmit a single radio frequency signal which is then converted to a binary signal for decoding and illumination of a preselected light of the display having a plurality of lights.

9. The method of claim 8, further including the step of modulating the RF carrier signal to have the characteristics of a pulsed tone.

10. The method of claim 8, further including the step of:

providing an RF signal in the range of frequencies from 300 to 340 megahertz.

11. The method of claim 10, further including the step of providing a frequency of 320 megahertz.

* * * * *